US005090173A

United States Patent [19]

Coggan et al.

[11] Patent Number: 5,090,173

[45] Date of Patent: Feb. 25, 1992

[54] LAPPED HARDBOARD PANELS AND METHOD

[75] Inventors: William G. Coggan, Rochester; John M. Guyette; James A. Pozzo, both of Troy, all of Mich.

[73] Assignee: Abitibi-Price Corporation, Troy, Mich.

[21] Appl. No.: 262,532

[22] Filed: Nov. 18, 1988

Related U.S. Application Data

[63] Continuation-in-part of Ser. No. 691,667, Jan. 15, 1985, Pat. No. 4,969,302.

[51] Int. Cl.[5] ..... D21J 1/18

[52] U.S. Cl. ..... 52/309.8; 162/109; 52/521; 52/536

[58] Field of Search ..... 52/536, 540, 541, 521, 52/592

[56] References Cited

U.S. PATENT DOCUMENTS 4,279,106 7/1981 Gleason et al. ..... 52/536

4,726,881 2/1988 Schultz ..... 162/117

*Primary Examiner*—David A. Scherbel

*Assistant Examiner*—Wynn Wood

*Attorney, Agent, or Firm*—Barnes, Kisselle, Raisch, Choate, Whittemore & Hulbert

[57] ABSTRACT

A hardboard lapped siding panel of wet processed wood fibers with substantial variations in density to provide a desired combination of improved characteristics. The panel is molded from a mat of wet wood fibers between a pair of heated upper and lower contoured plates. The upper plate is contoured to form the desired configuration of the front surface of the siding panel. The lower plate is contoured to provide the desired variations in density other improved characteristics of the panel. Preferably, the mat is molded on an underlying wire screen with a contour which is essentially the same as the contour of the lower plate.

19 Claims, 2 Drawing Sheets

LAPPED HARDBOARD PANELS AND METHOD

This is a continuation-in-part of copending U. S. patent application Ser. No. 06/691,667 filed on Jan. 15, 1985.

FIELD

This invention relates to hardboard panels and more particularly to a contoured and lapped hardboard panel and method of making it.

BACKGROUND

Flat hardboard panels of uniform density throughout have been made by a variety of wet and dry fiber processes. Some of these previously known wet and dry processes are disclosed in prior art U.S. Pat. No. 4,038,131. Hardboard panels produced by hot pressing a mat of dry fibers have some significantly different characteristics than hardboard panels produced by hot pressing wet or moist fibers. Typically, hardboard panels made by hot pressing wet fibers have a lower density, greater dimensional stability, less weight and a smooth outer face with substantially improved surface finish, lower rate of moisture and paint absorption and better weathering and painting characteristics.

A lapped siding panel of uniform density and a method of making this panel are disclosed in U.S. Pat. Nos. 4,726,881 and 4,622,190. The front and back faces of :his hardboard panel have essentially the same profile and are formed by hot pressing a wet fiber mat between a pair of plates having juxtaposed faces with complimentary contours. To permit moisture to escape, the wet mat is hot pressed on an underlying wire screen which is plastically deformed by the pressing so that it substantially follows the contour of the lower plate. When the press is opened, the formed panel is released from the lower press plate and the screen by tensioning the screen sufficiently to flatten or straighten it out. In the next hot pressing of another wet fiber mat the screen is again plastically deformed to conform to the contour of the lower plate. This repeated deforming and straightening of the wire screen is believed to cause it to rapidly deteriorate and break so that frequently it must be replaced with another screen.

SUMMARY

In accordance with this invention, a lapped hardboard siding panel is produced by a wet process with substantial variations of density throughout the panel to achieve a desired combination of improved characteristics, including enhanced paintability and weathering of its front surfaces, improved ruggedness, durability, impact resistance, and machining or cutting charactertisics of its side edges and front surfaces, enhanced strength and dimensional stability, and being relatively light weight. The lapped panel is molded in a hot press, preferably with an underlying screen between a pair of upper and lower contour plates. The upper plate is contoured to form the desired configuration of the front or exterior surface of the siding panel. The lower plate is contoured to provide variations in the density and enhanced surface and other improved characteristics of the formed panel. Preferably, the mesh screen has essentially the same contour as that of the lower plate. Preferably, to provide an overlapping joint construction for adjacent panels, such as a shiplap joint, complimentary lap portions are molded in the side edges of the panel and, if needed, also machined in areas not exposed to the exterior.

Objects, features and advantages of this invention are to provide a hardboard panel which has deeply offset or contoured wall portions, improved weathering and finishing characteristics of its exposed surface, enhanced impact resistance and durability of its side edges, improved nailing characterisitcs, clean cutting or sawing side edges, exposed surface and locator surfaces, eliminates panel framing or misalignment, when installed has uniform spacing and location of its outer faces from panel to panel, and is rugged, durable, dimensionally stable and realtively strong and light weight.

BRIEF DESCRIPTION OF THE DRAWINGS

These and other objects, features and advantages of this invention will be apparent from the following detailed description, appended claims and accompanying drawings in which:

DETAILED DESCRIPTION

Figure 1:
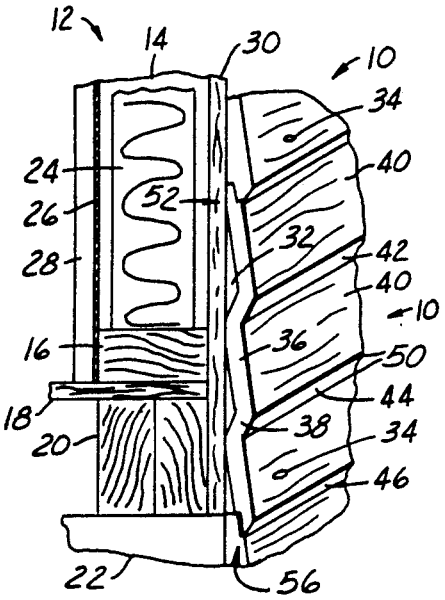
FIG. 1 is a perspective view with portions broken away of siding panels embodying this invention installed on an exterior frame wall of a building.
Figure 2:
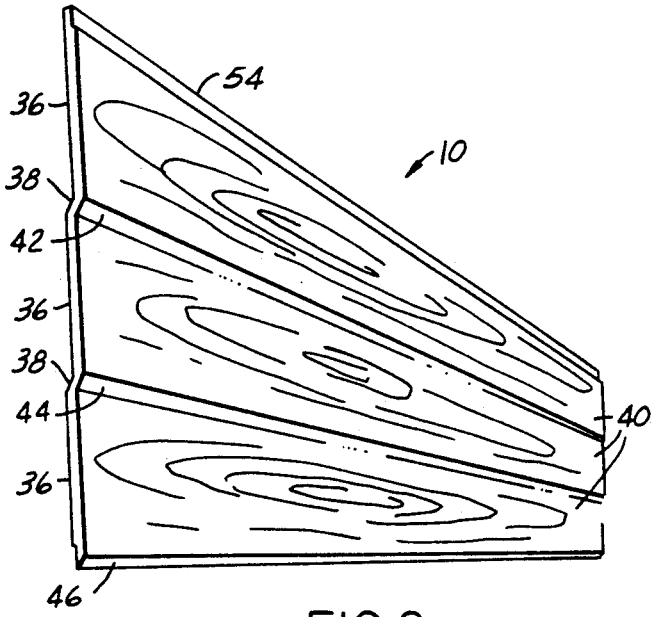
FIG. 2 is an enlarged perspective view of a siding panel embodying this invention.

Referring in more detail to the drawings, FIG. 1 illustrates siding panels 10 embodying this invention installed on an exterior frame wall 12 of a building. The frame wall has a plurality of spaced apart studs 14 secured by nails to a base plate 16 nailed to a sub-floor 18 supported by headers 20 received on a foundation wall 22. Normally, insulation 24 is installed between the studs and a vapor barrier 26 and dry wall 28 or plaster are secured to the inner face of the studs. Preferably, sheeting 30 is secured, such as by nails, to the outer face of the studs and a weather-resistant barrier 32, such as building paper, tar paper or felt, is applied over the sheeting. Courses of the siding panels 10 are installed and secured to the wall by fasteners, such as nails 34. While sheeting is usually preferred, the siding panels 10 do have sufficient strength that where building codes permit, the sheeting can be eliminated and the siding panels applied directly over the studs with adequate cross bracing being provided in the corner areas of the walls.

The siding panel 10 simulates three individual boards of lapped siding in assembled relation and has three inclined wall portions 36 integrally interconnected by offset portions 38. The outer surface has three generally flat and longitudinally extending outer faces 40 which are interconnected by bevel faces 42 and 44 in the offset portions providing drip edges. Another drip edge is provided by a bevel face 46 along the lower edge of the panel. Each bevel face is inclined to an adjacent outer face at an obtuse included angle 48 (FIG. 3) which is usually in the range of about 120° to 150° and preferably about 135°. Preferably, but not necessarily, the outer faces and drip edges are textured or embossed to provide the decorative appearance of wood graining and/or cross sawing, such as cross sawn natural fir or cedar wood.

In accordance with one feature of this invention, adjacent wall portions 36 are deeply transversely offset or stepped so that the adjacent outer faces 40 are spaced apart a transverse distance of at least 30% and usually about 40% to 70% of the maximum thickness of the panel. If desired, the outer faces can be stepped or offset a transverse distance even greater than the maximum thickness of the panel. Preferably, but not necessarily, the panel has relatively sharp transition surfaces 50 joining adjacent flat faces and drip edges with a radius which is not greater than 1½ times the maximum thickness of the panel, usually less than half the maximum thickness and often about one-fourth to one-tenth of the nominal maximum thickness of the panel.

Figure 3:
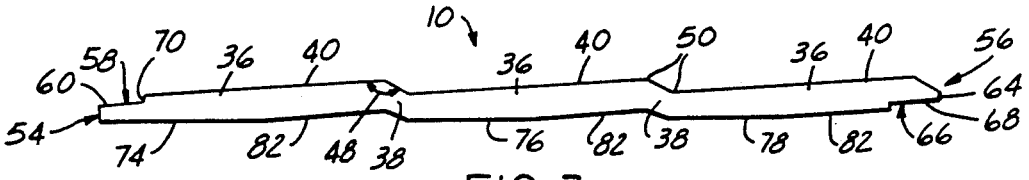
FIG. 3 is an end view of the siding panel of FIG. 2.
Figure 4:
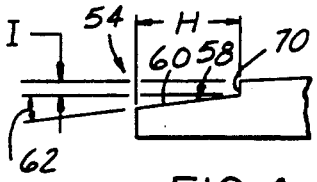
FIG. 4 is an enlarged and fragmentary end view of a tongue portion of the siding panel of FIG. 2.
Figure 5:
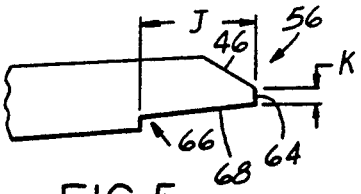
FIG. 5 is an enlarged and fragmentary end view of a nose portion of the siding panel of FIG. 2.

To facilitate assembly and provide a weather-tight joint between adjacent panels, the side edges of each panel are constructed and arranged to provide a shiplap joint 52. This joint is provided by a tongue 54 along the upper edge of each panel and a bull nose 56 extending along the lower edge of each panel. As shown in FIGS. 3 and 4, the tongue preferably has a rabbet extending along its upper edge, which is preferably machined, in the outer face of the panel. Preferably, the front face 60 of the tongue tapers toward the side edge at an angle 62 which is usually in the range of about 5° to 10°, and preferably about 7°. However, if desired the tongue face 60 could be parallel to the underlying back face with angle 60 being 0°.

The nose has a bevel outer face 46 providing a drip edge, a generally flat side edge 64 and an underlying rabbit 66. Preferably, the back face 68 of the rabbet tapers toward the lower edge and is inclined at an angle so that in assembly, it will be complimentary to and bear on the front face 60 of the tongue of an adjacent underlying panel. To align adjacent panels parallel to each other, preferably, the rabbets are dimensioned so that in assembly the edge 64 of the nose bears on a lip 70 of the tongue of an adjacent underlying panel.

To enhance the weather resistance of the siding panel, preferably its outer faces 40, drip edges 42, 44 & 46, tongue 54 and nose 56 are constructed and arranged so that, in assembly, the entire exposed outer surface of the panel is molded even though the rabbets are machined in the panel to form the desired tongue and nose configurations for shiplap joints.

To accurately locate courses of the panels in assembly and thereby insure proper mating of the tongue and nose of adjacent panels for a tight shiplap joint and eliminate unsightly panel to panel or course to course. mislaignment or framing, substantially flat and longitudinally extending locator faces 74, 76 & 78 are provided on the back surface of the panel These locator faces lie essentially in the same plane. For uniformity from panel to panel these locator surfaces are accurately positioned the same distances (within normal manufacturing tolerances) from the front faces 40 of all panels and mating inclined faces 60 & 68 of the tongue and nose of all panels. In mass production, this accurate positioning of these locator surfaces is accomplished by locating from the front faces 40 of each panel for machining the back locator faces and the rabbets 58 & 66 of the tongue and nose. Alternatively, this can be accomplished by locating from the front faces of each panel for machining the back locator faces and then locating from these machined locator faces for machining the rabbets of the tongue and nose. For these machining operations, the panels are also located off at least one of the side edges and preferably the nose edge 64.

In accordance with this invention, enhanced weathering, cutting and painting characteristics, and increased strength, durability and resistance to bumping and chipping of the side edges and drip edges, in a relatively lightweight panel, is achieved by varying the density of the hardboard across the width of the panel. The side edges, preferably, at least the lower portion of the drip edges, and at least part of the locator face areas have a density at least 10% greater, desirably at least 15% greater, and preferably about 30% greater than the minimum density of the hardboard panel. This variation in density is achieved by varying the thickness of the molded hardboard panel 80 (FIG. 6), from which the finished siding panel 10 is fabricated.

Figure 6:
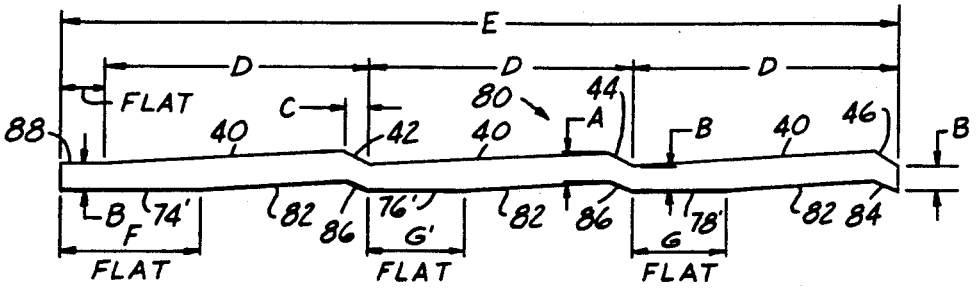
FIG. 6 is an end view of a wet molded hardboard panel made by the process of this invention from which the siding panel of FIG. 2 is fabricated.

As shown in FIG. 6, the back surface of the panel 80 is contoured to vary the thickness of the molded panel to achieve the desired density variations. Preferably, to minimize weight and enhance dimensional stability, the areas of minimum density and thus maximum thickness are in the wall portions 36 underlying the decorative front faces and, particularly the lower half to two thirds of these wall portions. In this area, the back faces 82 are preferably substantially parallel to the front faces 40. In the upper one third to one half of the wall portions 36 the density increases. This is accomplished by inclining the back faces 74', 76' & 78' in the locator areas so they taper or narrow down toward the offset portions 38 and the tongue 54. Preferably, these back faces are inclined to their associated front faces.

In the nose area, the thickness of the molded panel is reduced by inclining the back face 84 so that this area tapers or narrows down toward the side edge 64. Similarly, the back faces 86 of the offset portions are inclined toward their front faces so that they taper or narrow down toward the bottom of the drip edge. To increase the density of the tongue area, its thickness is reduced compared to the maximum thickness of the panel. Preferably, this is achieved by continuing the back face 74' of the locator area 74 to the edge of the panel and providing a front face 88 parallel thereto which is inclined to the adjacent front decorative face 40.

The selective densification of the side edges and back locator areas greatly facilitates the machining and resulting surface finish of these areas and reduces the rate of moisture absorption by the machined surfaces thereby enhancing product integrity. Highly satisfactory molded panels and finished siding have been produced with a maximum density of about 52 to 56 pounds per cubic foot, a minimum density of about 40 to 44 pounds per cubic foot, and an average density of about 45 to 49 pounds per cubic foot. Due to the nature of the wood fibers and the wet molding process, maximum densities greater than about 63 to 70 pounds per cubic foot cannot be achieved.

A highly satisfactory wet molded panel 80 has nominal dimensions of maximum thickness A of 0.410 of an inch, minimum thickness B of 0.340 of an inch, drip edge width C of 0.312 of an inch, outer face width D of 3.625 inches, overall width E of 11.50 inches, overall length of 16.00 feet, back face 74' width F of 1.937 inches, and back face 76' & 78' width G of 1.312 inches. The finished siding panel produced from this hardboard panel has nominal dimensions of tongue rabbet width H of 0.625 of an inch, lip depth I of 0.110 of an inch, nose rabbet width J of 0.687 of an inch and side edge thicknesses K of 0.1.10 of an inch. The rabbet faces 60 & 66 are inclined at an acute included angle of 7° to the back locator faces.

The hardboard panel 80 is made by molding a wet mat 90 (FIG. 7) of wood fibers. The wood fibers can be prepared by cooking and mechanically refining wood chips, chemically treating them and adding a binding resin. The wet mat can be formed by draining an aqueous suspension of the wood fibers, preferably by depositing them on a wire screen or other perforate surface in accordance with known fiberboard manufacturing process and techniques. The wet mat may be partially dewatered by rolling or cold pressing it so that on a dry weight basis it has a moisture content of about 65% to 75% and preferably 70%. Preferably, but not necessarily, a paper overlay with a bonding agent is applied to the upper surface of the wet mat to improve the surface finish, weathering and painting characteristics of the exposed face of the finished siding panel. Suitable processes and techniques for preparing the wood fiber, forming the wet or moist mat and applying the proper overlay are disclosed in U.S Pat. No. 4,038,131 the disclosure of which is incorporated herein by reference and will not be further described herein.

Figure 7:
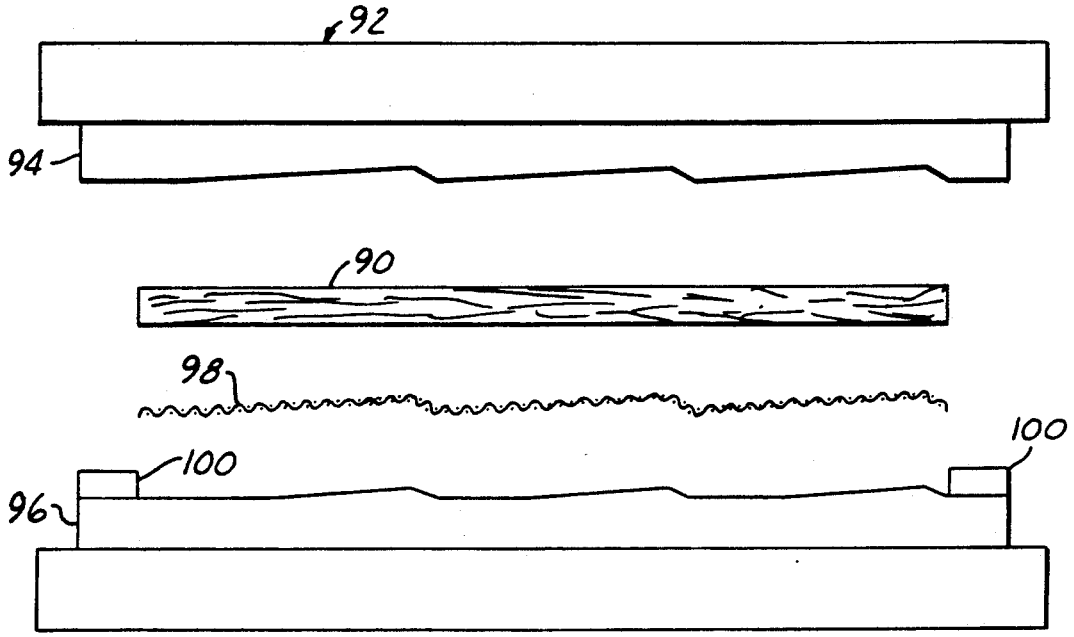
FIG. 7 is a fragmentary end view of a pair of contoured upper and lower press plates in their open position with a wet fiber mat and a wire screen disposed between them which are used to hot mold the fiber mat to make the hardboard panel of FIG. 6.

Preferably, the wet mat has a nominal width of about 4 feet and a length of 16 feet for simultaneously molding in one piece four panels 80 each having a nominal width of about 11½ inches and a length of 16 feet which will subsequently be cut into four individual panels after molding and curing has been completed. Preferably, the fiber mat 90 is molded in a press 92 between heated top and bottom pressure plates 94 & 96 and a wire mesh screen 98. The plates and screen are contoured to produce the desired configuration of the front and back surfaces of the molded panel. FIG. 7 illustrates only a sufficient portion of the press, plates and screen for molding one of the four sections or panels from a mat four feet wide and 16 feet long.

The top plate 94 has a contour and surfaces complimentary to and which form the upper surfaces of the molded panel. The lower plate 96 and wire screen 98 have a contour and surfaces which are substantially complimentary to and form the bottom surfaces of the panel. To permit moisture to escape when the mat is being molded, the wire screen 98 is disposed in the mold between the mat and the lower plate. Because of this screen, the configuration of the bottom surfaces of the molded panel may not conform exactly to the configuration of the lower plate, particularly in the areas of the sharp bends associated with the offset portions and drip edges. To better control the thickness of the molded panel, facilitate a rapid hot molding press cycle and insure rapid dissipation of steam without delamination of the molded panel, stop bars 100 are disposed between the press plates and extend along their longitudinal edges.

For molding a wet fiber mat having a nominal width of 4 feet, length of 16 feet, and a thickness of about 2 inches to form four panels 80 having a maximum nominal thickness of about 0.410 of an inch, the press is fully closed to mold the mat for about 10 minutes with the top and bottom plates heated to a temperature of about 400° to 450° F. To avoid any structural damage to the mat, the plates are moved from the open position to the fully closed position bearing on the stops 100 in about 20 seconds, and after molding the press is opened in about 15 seconds for a total molding time of about 10½ minutes. As the press closes, the mat is subjected to a maximum pressure of about 150 pounds per square inch. As the mat is molded, its upper face recedes from the top plate thereby decreasing the pressure on the fibers and allowing some of the moisture converted to steam to escape through the upper surface of the mat. The receding of the upper mat surface from the top plate enablels the molding process to be conducted at higher temperatures without charring, discoloring or damage to any paper overlay and the upper surface of the molded mat.

Figure 8:
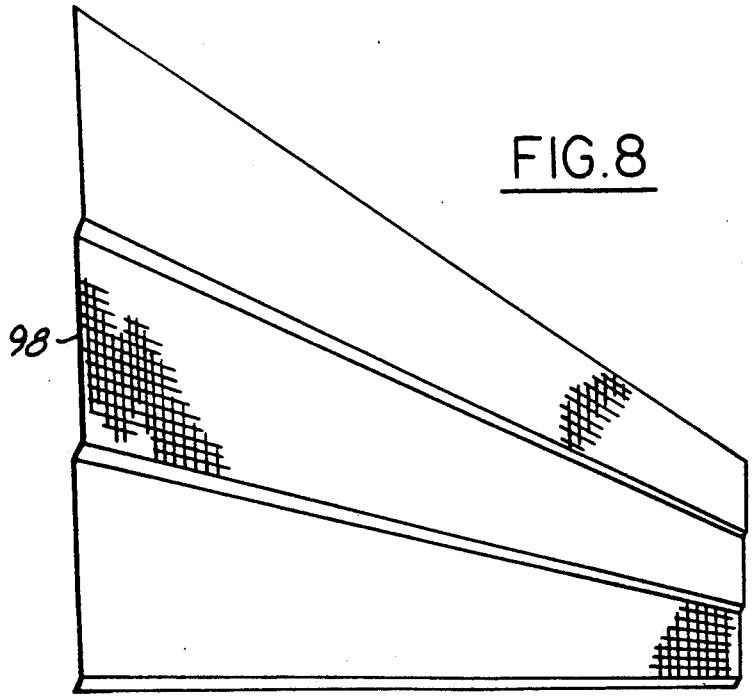
FIG. 8 is an enlarged perspective view of the screen of FIG. 7.

After molding is completed and the press is opened, the molded and partially cured or green panel along with the screen 98 is removed from the press. Preferably, the green panel is separated from the mesh screen. The screen is cleaned and then returned to the press along with another wet mat for molding additonal panels. Because the wire screen is permanently deformed (as shown in FIG. 8) to conform to the contour of the bottom plate, it is preferable to reuse a given screen with only one specific lower plate. This matching and use of a given screen with a specific lower plate minimizes repeated permanent deformation and work hardening of the screen and hence increases its useful life. This matching and reuse also decreases the wearing away of the lower plate and facilitates accurate registration of the screen and plate which improves dimensional control of the molded panels.

To reduce the press cycle time, preferably the molded panel is only partially cured in the press and typically still has a moisture content on a dry weight basis of 15% to 40% and preferably about 30%. The partially cured or green panel is baked, usually for several hours, at 250° F. to 350° F., to complete the curing process. After being cured, the panel is usually passed through a humidification chamber to increase its moisture content to about 7% by weight. After humidification, the 4 by 16 feet molded and fully cured sheets are cut and separated into four individual panels having a nominal size of 11.5 inches by 16 feet. Thereafter, the rabbets for the tongue and nose of the side edges are machined and the flat back locator faces are machined such as by planing or preferably by sanding.

After machining is completed, a liquid coat or coats of a primer are applied to the outer face of the panels and dried and cured thereon. If desired, a prefinished siding panel can be provided by applying a finish coat or coats of suitable resins, such as thermoset acrylic latex resins, over the primer and baking them. If desired, the durability of the prefinished siding panel can be further enhanced by applying a clear topcoat over the finish coat, such as a transparent thermoset acrylic latex resin, and then baking it.

We claim:

1. A hardboard panel molded by a wet process with heat and compression of a relatively thick mat of wet composite wood fiber material into a thinner hardboard panel between a pair of contoured upper and lower pressure plates heated to an elevated temperature; the hardboard panel having a contoured front surface, a pair of spaced apart and generally longitudinally extending side edges, and a contoured back surface generally similar to but not matching the profile of said front surface, said panel having at least two longitudinally and laterally extending wall portions each with a front face and a generally longitudinally extending offset and integral wall portion between them constructed and arranged to generally transversely offset said front faces a distance equal to at least three tenths of the maximum thickness of said hardboard panel, in cross section said hardboard panel as molded having a nonuniform density across its width with its density at said side edges being at least ten percent greater than the minimum density of said lateral wall portions and as molded the minimum thickness of said side edges being at least ten percent less than the maximum thickness of said lateral wall portions, said maximum density being less than seventy pounds per cubic foot and said hardboard panel having an average density of less than fifty pounds per cubic foot.

2. The hardboard panel of claim 1 in which one of said side edges terminates in a nose extending longitudinally and having a longitudinally extending outer face inclined at an obtuse included angle to an adjacent front face to provide a drip edge and said nose tapering toward said one side edge of said panel.

3. The hardboard panel of claim 2 wherein said nose also comprises a rabbet machined in the back surface of said panel adjacent said one side edge, underlying said inclined outer face, opening onto said one side edge without breaking into either one of said inclined outer face of said nose and adjacent front face of said panel, and constructed and arranged when in assembly with another panel to receive a tongue adjacent the other side edge of such another panel to provide a lap joint between said panel and such another panel.

4. The hardboard panel of claim 1 in which one of said side edges terminates in a tongue extending longitudinally and a recess in the front surface extending longitudinally and constructed and arranged when in assembly with another panel to underlie the other edge of such another panel to provide a lap joint between said panel and such another panel.

5. The hardboard panel of claim 2 in which the other of said side edges terminates in a tongue with a machined rabbet in the front surface extending longitudinally thereof, and said tongue is constructed and arranged, when in assembly with another similar panel to underlie the nose of such another panel to provide a lap joint between said panel and such another panel with all the exposed portion of the entire front surface of said panel being formed by the molding thereof.

6. The hardboard panel of claim 3 in which the other of said side edges terminates in a tongue with a machined rabbet in the front surface extending longitudinally thereof, and said tongue is constructed and arranged, when in assembly with another similar panel to underlie the nose of such another panel to provide a lap joint between said panel and such another panel with all the exposed portions of the entire front surface of said panel being formed by the molding thereof.

7. The hardboard panel of claim 2 in which the other of said side edges terminates in a tongue extending longitudinally thereof, and constructed and arranged, when in assembly with another similar panel to underlie the nose of such another panel to provide a lap joint between said panel and such another panel with the exposed portions of the entire front surface of said panel being formed by the molding thereof.

8. The hardboard panel of claim 1 in which said front faces when molded are embossed to provide a textured decorative surface thereon.

9. The hardboard panel of claim 1 which also comprises a paper overlay which is applied to the wet mat prior to molding and is pressed and molded with the wet mat on the front surface of said panel.

10. The hardboard panel of claim 9 which also comprises at least one coat of a liquid primer applied to and cured at an elevated temperature to a dry film on the front surface of said panel over said paper overlay after said panel has been molded.

11. The hardboard panel of claim 1 which also comprises at least one coat of a liquid primer applied to and cured at an elevated temperature to a dry film on the front surface of said panel after said panel has been molded.

12. The hardboard panel of clair 1 in which each lateral wall portion has a flat back face extending longitudinally of said panel and inclined at an acute included angle to its associated front face, and all of said flat back faces lie in substantially the same plane, whereby in assembly said flat back faces provide support surfaces for said panel.

13. The hardboard panel of claim 12 in which in cross section the thickness and density of each said lateral wall portions varies across said back face with the maximum density thereof being at least ten percent greater than the minimum density of said hardboard panel, and said variation in density is produced when molding said panel.

14. The hardboard panel of claim 13 in which each of said flat back faces is machined to predetermined dimensions relative to its associated front face of said panel so that a plurality of such panels have substantially the same such predetermined dimensions within normal manufacturing tolerances to facilitate assembly and alignment of a plurality of such panels on a supporting structure.

15. The hardboard panel of claim 3 in which each lateral wall portion has a flat back face extending longitudinally of said panel and inclined at an acute included angle to its associated front face, and all of said flat back faces lie in substantially the same plane, whereby in assembly said flat back faces provide support surfaces for said panel.

16. The hardboard panel of claim 15 in which said rabbet of said nose is machined to predetermined dimensions within normal manufacturing tolerances relative to said flat back face adjacent thereto so as to facilitate the alignment and assembly with lap joints of a plurality of such panels on a supporting structure.

17. The hardboard panel of claim 6 in which each lateral wall portion has a flat back face extending longitudinally of said panel and inclined at an acute included angle to its associated front face, and all of said flat back faces lie in substantially the same plane whereby in assembly said flat back faces provide support surfaces for said Panel.

18. The hardboard panel of claim 17 in which said flat back faces are machined to predetermined dimensions within normal manufacturing tolerances relative to said rabbets of said tongue and said nose so as to facilitate the alignment and assembly with lap joints of a plurality of such panels on a supporting structure.

19. A hardboard panel formed from a relatively thick mat of composite wood fiber material compressed and molded into a thinner hardboard panel having a contoured from surface, a pair of spaced apart and generally longitudinally extending side edges, and a contoured back surface generally similar to but not matching the profile of said front surface, said panel having at least two longitudinally and laterally extending wall portions each with a front face and a generally longitudinally extending and integral offset wall portion between them constructed and arranged to generally transversely offset said front faces a distance equal to at least three tenths of the maximum thickness of said hardboard panel, in cross section said hardboard panel as molded having a non-uniform density across its width with its density at said side edges being at least ten percent greater than the minimum density of said lateral wall portions and as molded the minimum thickness of said side edges being at least ten percent less than the maximum thickness of said lateral wall portions, said maximum density being less than seventy pounds per cubic foot and said hardboard panel having an average density of less than fifty pounds per cubic foot.

* * * * *